US009060622B2

(12) United States Patent
Neumann et al.

(10) Patent No.: US 9,060,622 B2
(45) Date of Patent: Jun. 23, 2015

(54) EXPANDABLE RACK AND SHELVES

(75) Inventors: Eric Neumann, North Hills, NY (US); Mark Beddison, Long Beach, NY (US); Bruce Gommermann, Northport, NY (US)

(73) Assignee: Display Technologies, LLC, Lake Success, NY (US)

( * ) Notice: Subject to any disclaimer, the term of this patent is extended or adjusted under 35 U.S.C. 154(b) by 52 days.

(21) Appl. No.: 13/701,625

(22) PCT Filed: Jun. 6, 2011

(86) PCT No.: PCT/US2011/039286

§ 371 (c)(1), (2), (4) Date: Mar. 18, 2013

(87) PCT Pub. No.: WO2011/153535

PCT Pub. Date: Dec. 8, 2011

(65) Prior Publication Data

US 2013/0200027 A1 Aug. 8, 2013

Related U.S. Application Data

(60) Provisional application No. 61/351,596, filed on Jun. 4, 2010.

(51) Int. Cl.
*A47F 5/00* (2006.01)
*A47B 45/00* (2006.01)
(Continued)

(52) U.S. Cl.
CPC ..... *A47F 5/0018* (2013.01); *A47B 45/00* (2013.01); *A47B 96/025* (2013.01); *A47F 5/0093* (2013.01); *A47F 5/137* (2013.01); *A47F 2005/0075* (2013.01)

(58) Field of Classification Search
CPC ..... A47B 45/00; A47B 96/025; A47F 2005/0075; A47F 3/06; A47F 5/0068; A47F 5/0093; A47F 5/137
USPC ..... 211/42, 54.1, 102, 137, 105.3; 108/26, 108/85, 90.01, 90.02, 90.03, 90.04, 134, 108/153, 175, 186, 189, 195, 201; 248/172, 248/670, 200.1; 312/205
See application file for complete search history.

(56) References Cited

U.S. PATENT DOCUMENTS 1,272,175 A * 7/1918 Albright ..... 211/41.1
1,531,837 A * 3/1925 Boldin ..... 108/131
(Continued)

FOREIGN PATENT DOCUMENTS

DE 102004014307 A1 * 10/2005 ..... B62B 3/02
FR 1291776 * 3/1961 ..... A47B 5/00

OTHER PUBLICATIONS

International Search Report for International Application No. PCT/US2011/039286 date of completion Oct. 6, 2011 (1 page).

*Primary Examiner* — Joshua Rodden
(74) *Attorney, Agent, or Firm* — Carter, DeLuca, Farrell & Schmidt, LLP

(57) ABSTRACT

An expandable rack including a plurality of vertical frame members and a plurality of adjustable shelves is disclosed. Each adjustable shelf is at least partially supported by at least some of the vertical frame members. Each adjustable shelf comprises a first portion and a second portion. The first portion includes a lateral beam and at least one first arm extending perpendicularly from the lateral beam. The first arm includes a polygonal cross-section. The second portion includes a lateral beam and at least one second arm extending perpendicularly therefrom. The second arm includes a polygonal cross-section. The first arm is dimensioned to fit within the second arm in a telescoping relationship.

6 Claims, 9 Drawing Sheets

(51) Int. Cl.

| | |
|---|---|
| ***A47B 96/02*** | (2006.01) |
| ***A47F 5/13*** | (2006.01) |

(56) References Cited

U.S. PATENT DOCUMENTS

| | | | | | |
|---|---|---|---|---|---|
| 2,909,349 | A | * | 10/1959 | Morris | 108/54.1 |
| 2,961,250 | A | * | 11/1960 | Beach | 280/35 |
| 4,519,508 | A | * | 5/1985 | Gullett et al. | 211/59.2 |
| 5,080,320 | A | * | 1/1992 | Chieng | 248/670 |
| 5,131,547 | A | * | 7/1992 | Goldberg | 211/149 |
| 5,249,823 | A | * | 10/1993 | McCoy et al. | 280/656 |
| 5,295,596 | A | * | 3/1994 | Squitieri | 211/175 |
| 5,599,031 | A | * | 2/1997 | Hodges | 280/79.11 |
| 5,624,044 | A | | 4/1997 | Black, Jr. | |
| 5,645,182 | A | * | 7/1997 | Miller et al. | 211/134 |
| 5,660,286 | A | | 8/1997 | Shea | |
| 5,797,213 | A | * | 8/1998 | Frick | 43/54.1 |
| D444,656 | S | * | 7/2001 | West | D6/511 |
| D445,618 | S | * | 7/2001 | West | D6/511 |
| 6,364,137 | B1 | * | 4/2002 | Glauth et al. | 211/186 |
| 6,789,688 | B2 | * | 9/2004 | Roush et al. | 211/201 |
| 7,150,364 | B2 | * | 12/2006 | Jablow et al. | 211/153 |
| 7,806,283 | B2 | * | 10/2010 | Metcalf | 211/175 |
| 7,810,657 | B2 | * | 10/2010 | Davison et al. | 211/175 |
| 8,141,683 | B1 | * | 3/2012 | Wurth et al. | 182/223 |
| 8,353,490 | B2 | * | 1/2013 | Spinelli | 248/201 |
| 2012/0074087 | A1 | * | 3/2012 | Neumann et al. | 211/134 |

* cited by examiner

EXPANDABLE RACK AND SHELVES

CROSS-REFERENCE TO RELATED APPLICATIONS

The present application is a National Stage Entry of PCT/US2011/039286, filed on Jun. 6, 2011, which claims the benefit of, and priority to, U.S. Provisional Patent Application Ser. No. 61/351,596 filed on Jun. 4, 2010, the entire contents of each of these prior applications are hereby incorporated by reference in their entirety.

BACKGROUND

The present disclosure relates to a rack, and to portions thereof, that can be adjusted in width. The rack includes a plurality of adjustable shelves, and a plurality of (e.g., four) vertical frame members. The rack may be used in retail environments to store and/or display a plurality of retail items, such as two-liter beverage bottles, for example.

Typically, in retail environments, for example, floor/shelf space is limited and the retailers attempt to maximize the amount of products they can store/display in their retail space. Additionally, racks are commonly used to display various types of items throughout the store. However, sizes and shapes of the items displayed on the racks vary from item to item. Therefore, the racks are often not utilized most efficiently, as empty spaces result. That is, typical racks may be designed and sized to optimally hold a particular quantity of a particular item (e.g., 48 two-liter soda bottles). But, if that same rack is used to hold another type of item (e.g., bags of potato chips), empty spaces on each shelf of the rack will result.

The rack of the present disclosure is adjustable in width. The width of the rack is adjustable via the adjustable shelves. Therefore, the expandable rack can be configured to efficiently accommodate a desired numbers of items thereon.

SUMMARY

The present disclosure relates to an expandable rack including a plurality of vertical frame members and a plurality of adjustable shelves. Each adjustable shelf is at least partially supported by at least some of the vertical frame members. Each adjustable shelf comprises a first portion and a second portion. The first portion includes a lateral beam and at least one first arm extending perpendicularly from the lateral beam. The first arm includes a polygonal cross-section. The second portion includes a lateral beam and at least one second arm extending perpendicularly therefrom. The second arm includes a polygonal cross-section. The first arm is dimensioned to fit within the second arm in a telescoping relationship.

The present disclosure also relates to an adjustable shelf. The adjustable shelf comprises a first portion including a lateral beam and at least one first arm extending perpendicularly from the lateral beam. The first arm includes a rectangular cross-section. The second portion includes a lateral beam and at least one second arm extending perpendicularly from the lateral beam. The second arm includes a rectangular cross-section. The first arm is dimensioned to fit at least partially within the second arm in a telescoping relationship.

BRIEF DESCRIPTION OF DRAWINGS

Embodiments of the present disclosure are described hereinbelow with reference to the drawings wherein.

DETAILED DESCRIPTION

Embodiments of the presently disclosed expandable rack and shelves are described in detail with reference to the drawings wherein like numerals designate identical or corresponding elements in each of the several views. In the descriptions that follow, the term "proximal," as is traditional, will refer to the portion of the expandable rack and/or shelves which is closer to the user (e.g., consumer), while the term "distal" will refer to the portion which is farther from the user.

Figure 1:
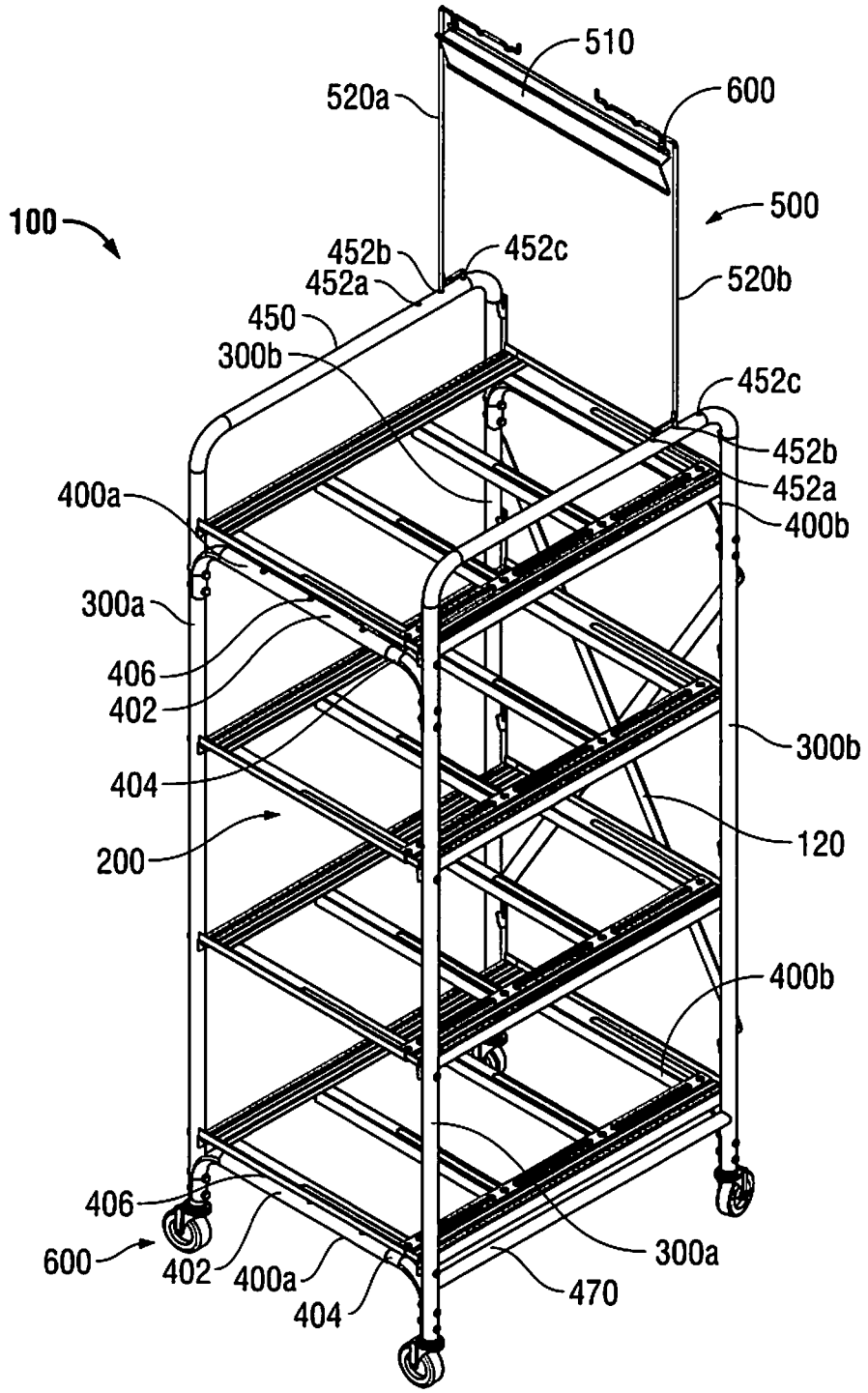
FIG. 1 is a perspective view of the expandable rack and shelves of the present disclosure.

With reference to the accompanying figures (e.g., FIG. 1), the rack 100 includes a plurality of shelves 200, a plurality of vertical frame members 300, adjustable connecting members 400, upper connecting members 450, lower connecting members 470, and a signage display system 500. As illustrated, the rack 100 may also include stabilizing members 120.

In the illustrated embodiments, rack 100 includes four adjustable shelves 200 which each extend between vertical frame members 300. Specifically, rack 100 includes two proximal vertical frame members 300*a*, and two distal vertical frame members 300*b*. Adjustable connecting members 400 extend between vertical frame members 300. Specifically, proximal adjustable connecting members 400*a* connect proximal vertical frame members 300*a* to each other, and distal adjustable connecting members 400*b* connect distal vertical frame members 300*b* to each other. Upper connecting members 450 and lower connecting members 470 each connect a proximal upper frame member 300*a* to an adjacent distal frame member 300*b*. A pair of stabilizing members 120 crisscross each other to form an "X" shape while connecting distal vertical frame members 300*b* to each other. Additionally, in the illustrated embodiment, a caster 600 is disposed beneath each vertical frame member 300.

Signage display system 500 includes a signage display 510 and a pair of signage supports 520. It is envisioned that signage display 510 can be used to display product information thereon, for example. Signage supports 520 extend vertically from upper connecting members 450 and support signage display 510. Signage supports 520 are sized such that signage display 510 is visible when products (e.g., soda bottles) are present on the upper shelf 200.

Figure 2:
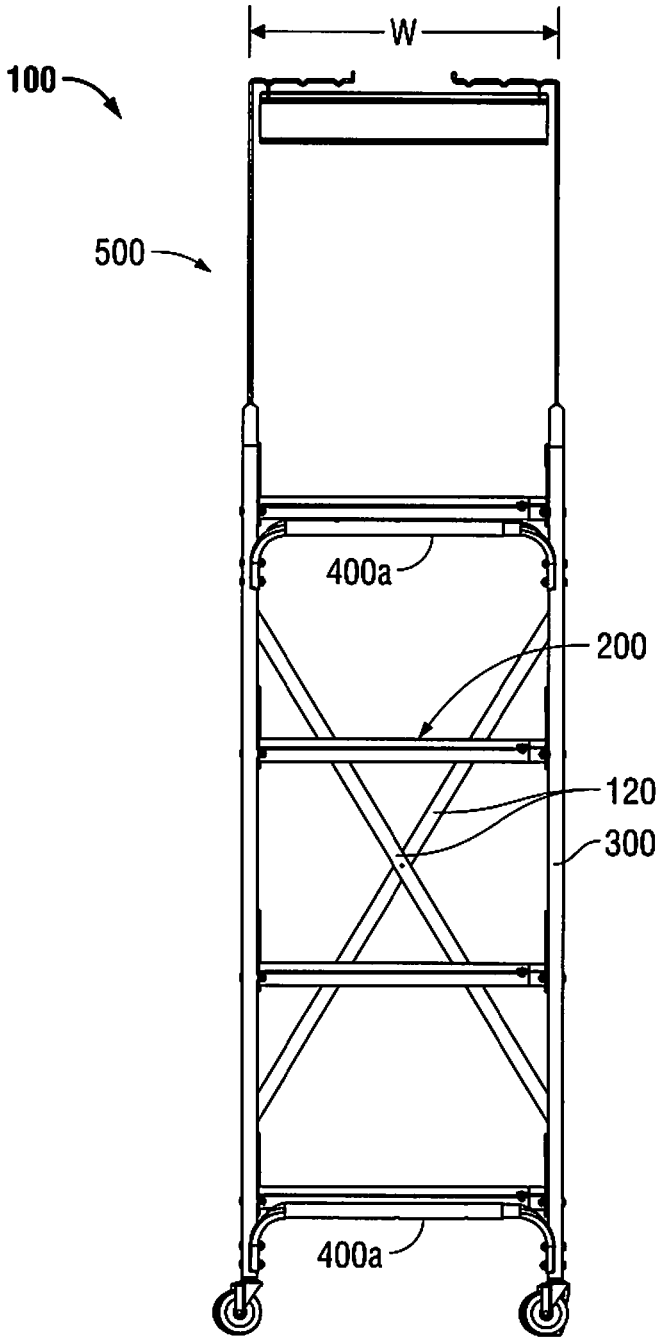
FIG. 2 is a front view of the expandable rack and shelves of FIG. 1.
Figure 3:
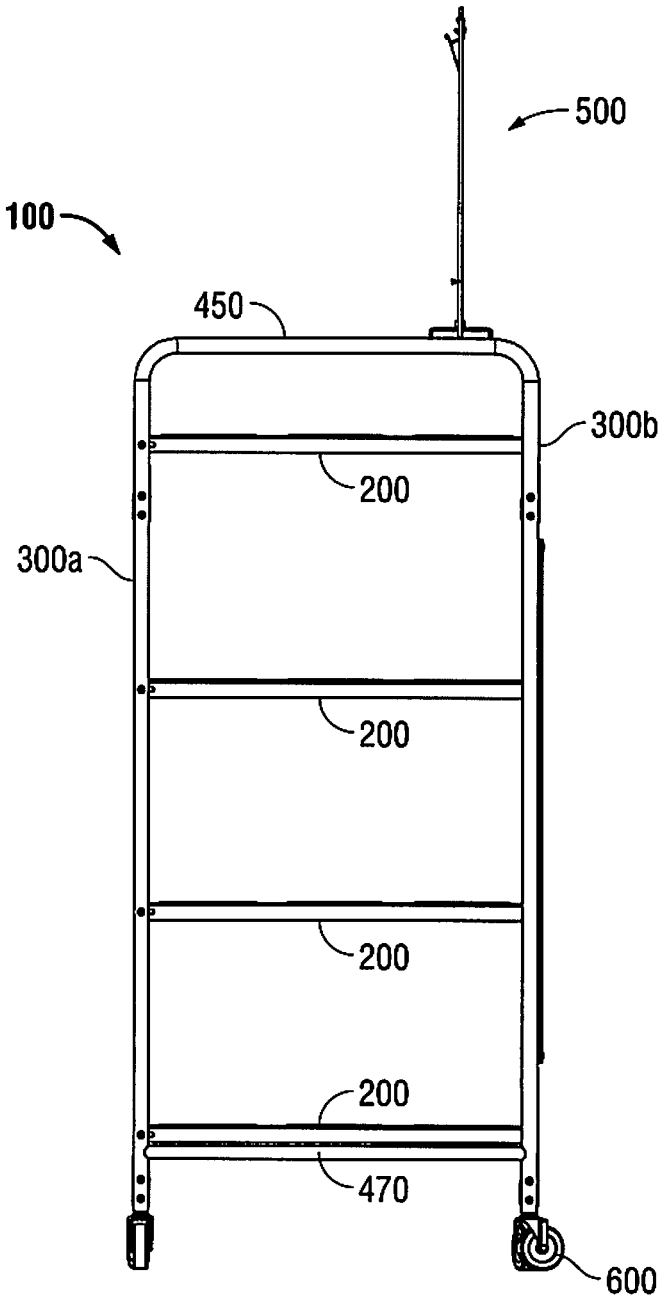
FIG. 3 is a side view of the expandable rack and shelves of FIGS. 1 and 2.

As discussed above, rack 100 is expandable along its width "W" (FIG. 2). Several features of rack 100 enable its expandability. For example, adjustable shelves 200, adjustable connecting members 400, stabilizing members 120, and signage supports 520 all facilitate the expandability of rack 100.

Figure 6A:
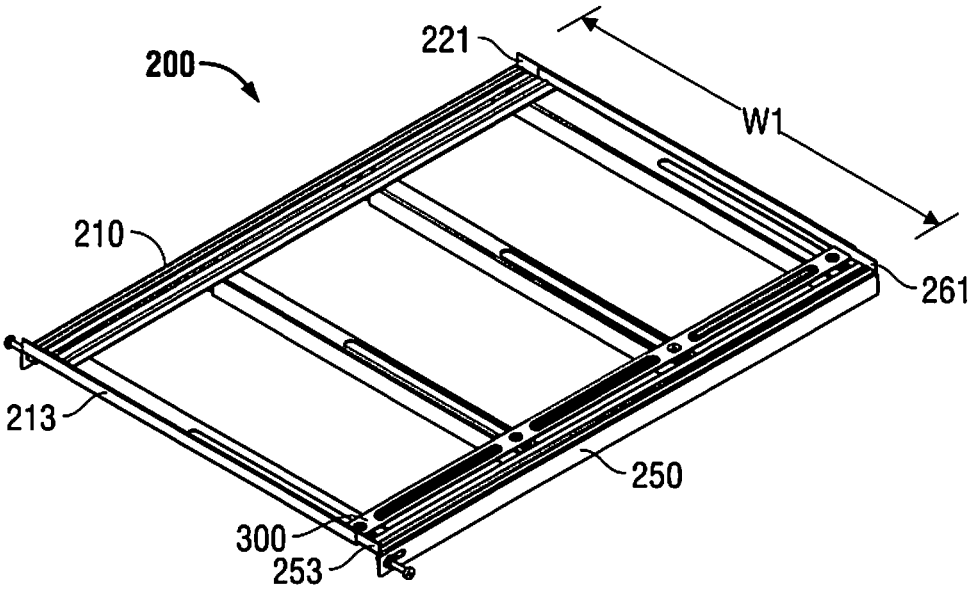
FIGS. 6A-6C are perspective views of an expandable shelf of the present disclosure illustrated in various stages of expansion.

With particular reference to FIGS. 6A-9, adjustable shelf 200 is illustrated. As shown in FIGS. 6A-6C, adjustable shelf 200 is extendable between various different widths (e.g., "W1," "W2," and "W3"). As can be appreciated, adjustable shelf 200 is not limited to three widths, an infinite number of different widths is possible. Adjustable shelf 200 includes a first portion 210, a second portion 250, and a third portion 300.

Figure 7:
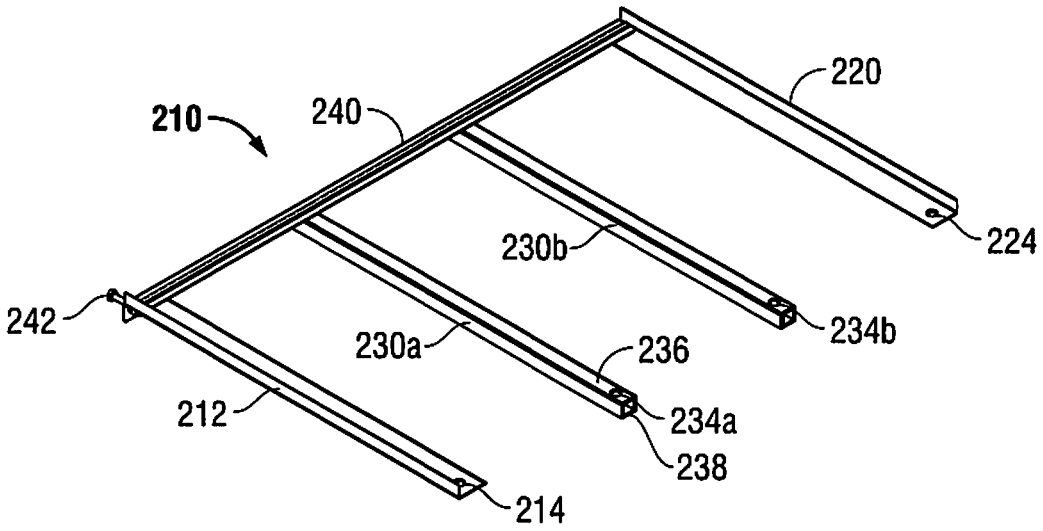
FIGS. 7-9 are perspective views of various components of the expandable shelf of FIGS. 6A-6C.

With reference to FIG. 7, first portion 210 includes a proximal beam 212, a distal beam 220, a pair of arms 230*a*, 230*b*, and a lateral beam 240. Beams 212, 220 and arms 230*a*, 230*b* (more or fewer than the illustrated number of arms are envisioned) extend substantially perpendicularly from and are cantilevered with respect to lateral beam 240. In the illustrated embodiment, proximal beam 212 and distal beam 220 have an "L"-shaped cross-section, and arms 230*a*, 230*b* have a polygonal (e.g., rectangular, square, etc.) cross-section. Each of proximal beam 212, distal beam 220, and arms 230*a*, 230*b* also include a respective hole 214, 224, 234*a*, 234*b* extending at least partially therethrough. It is envisioned that holes 234*a*, 234*b* either extend through upper section 236 and lower section 238 of arms 230*a*, 230*b*, or solely through upper section 236. In the illustrated embodiment, all holes 214, 224, 234*a*, 234*b* are on the same plane as each other.

Additionally, a pin 242 extends from a proximal portion of lateral beam 240 in a direction opposite the direction proximal beam 212 extends. Pin 242 is configured to engage a portion of one of the vertical frame members 300 (e.g., a proximal vertical frame member 300*a*). For example, it is envisioned that pin 242 is at least partially insertable through a hole in vertical frame member 300, and/or that the pin 242 resembles a nut/bolt combination for releasable connection between first portion 210 and vertical frame member 300. A distal portion of first portion 210 may rest on a portion of a vertical frame member 300 (e.g., a distal vertical frame member 300*b*) and/or may engage/connect to vertical frame member 300 in another suitable manner (e.g., a pin/hole connection).

Figure 9:
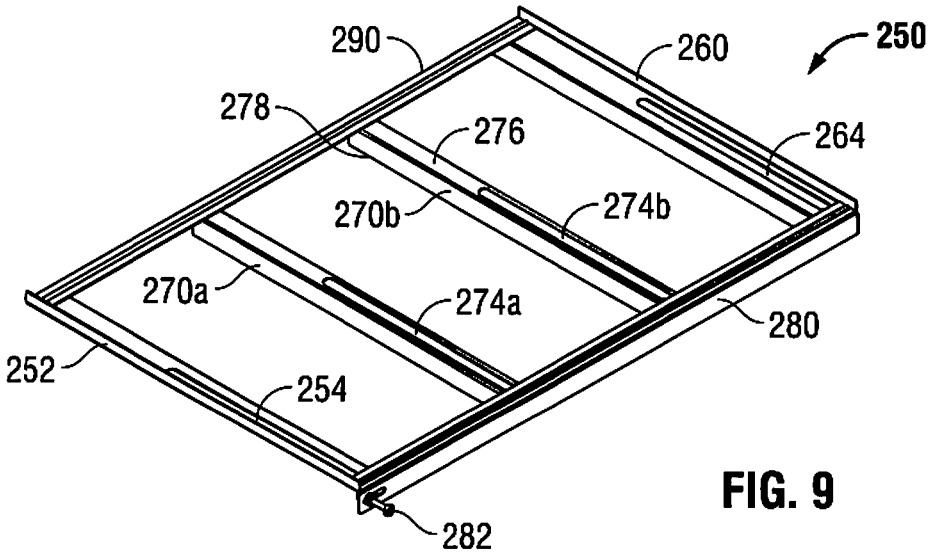

With reference to FIG. 9, second portion 250 of adjustable shelf 200 includes a proximal beam 252, a distal beam 260, a pair of arms 270*a*, 270*b*, a first lateral beam 280, and a second lateral beam 290. Beams 252, 260 and arms 270*a*, 270*b* (more or fewer than the illustrated number of arms are envisioned) extend substantially perpendicularly between first lateral beam 280 and second lateral beam 290. In the illustrated embodiment, proximal beam 252 and distal beam 260 have an "L"-shaped cross-section, and arms 270*a*, 270*b* have a polygonal (e.g., rectangular, square, etc.) cross-section. Each of proximal beam 252, distal beam 260, and arms 270*a*, 270*b* also include a respective slot 254, 264, 274*a*, 274*b* extending at least partially therethrough. It is envisioned that slots 274*a*, 274*b* either extend through upper section 276 and lower section 278 of arms 270*a*, 270*b*, or solely through upper section 276. In the illustrated embodiment, all slots 254, 264, 274*a*, 274*b* are on the same plane as each other. The plane of the slots 254, 264, 274*a*, 274*b* is different from the plane of the holes 214, 224, 234*a*, 234*b*.

Additionally, a pin 282 extends from a proximal portion of first lateral beam 280 in a direction opposite second lateral beam 290. Pin 282 is configured to engage a portion of one of the vertical frame members 300 (e.g., a proximal vertical frame member 300*a*). For example, it is envisioned that pin 282 is at least partially insertable through a hole in vertical frame member 300, and/or that the pin 282 resembles a nut/bolt combination or releasable connection between second portion 250 and vertical frame member 300. A distal portion of second portion 250 may rest on a portion of a vertical frame member 300 (e.g., a distal vertical frame member 300*b*) and/or may engage/connect to vertical frame member 300 in another suitable manner (e.g., a pin/hole connection).

Figure 8:
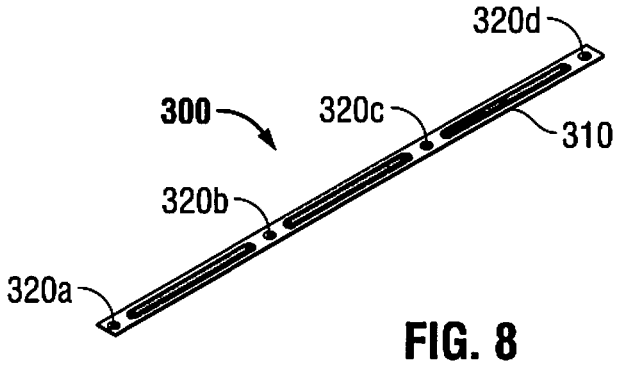

With reference to FIG. 8, third portion 300 of adjustable shelf 200 is an elongated strip 310 that is configured to engage first portion 210 and second portion 250 of adjustable shelf 200. In particular, third portion 300 includes four connectors or pins 320*a*-320*d* extending downwardly from elongated strip 310. Each pin 320*a*-320*d* is configured to align with and engage respective holes 214, 224, 234*a*, 234*b* of first portion 210 and slots 254, 264, 274*a*, 274*b* of second portion 250 after first portion 210 and second portion 250 have properly engaged each other, as discussed below.

Figure 6B:
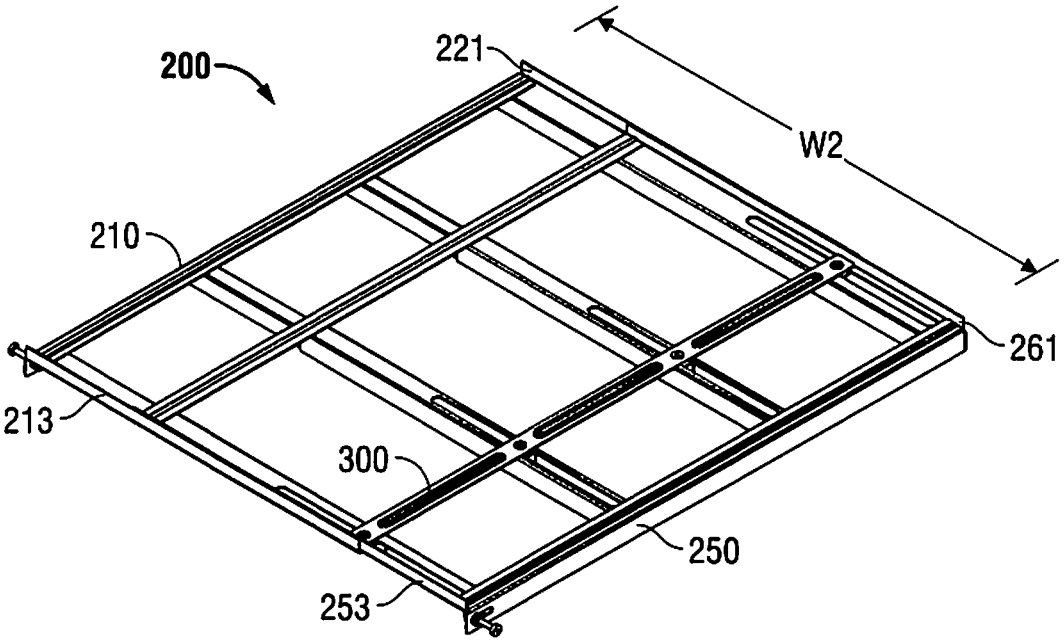
Figure 6C:
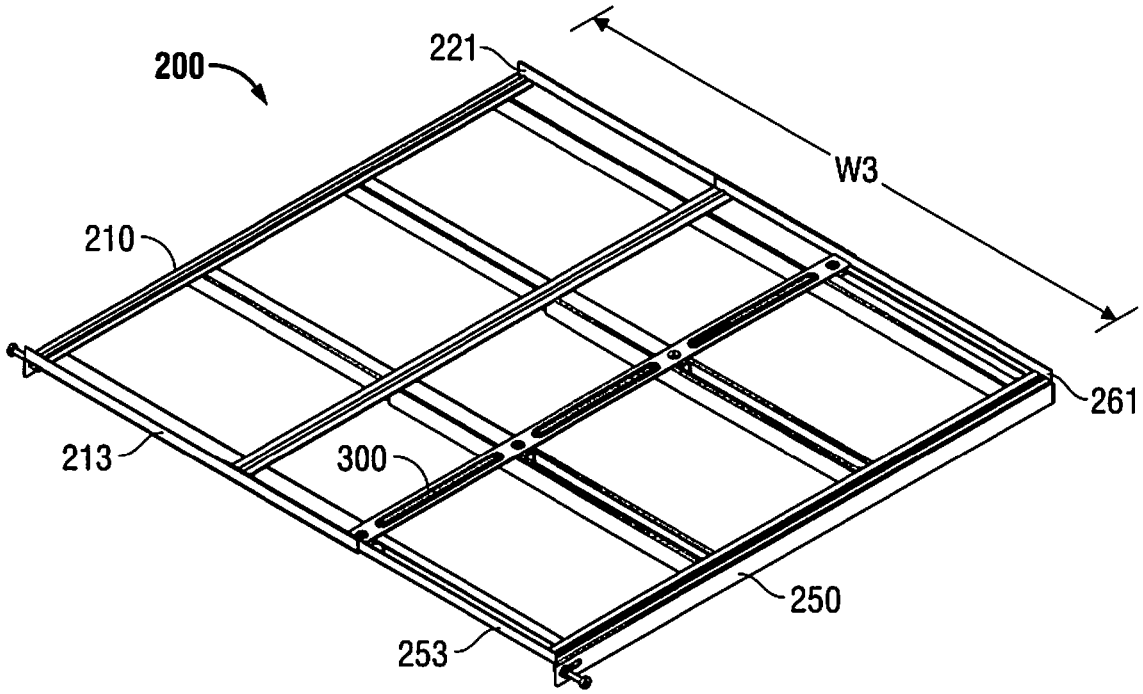

To assemble adjustable shelf 200, a user approximates first portion 210 and second portion 250 of adjustable shelf 200. In particular, arms 230*a*, 230*b* of first portion 210 are inserted at least partially into arms 270*a*, 270*b* of second portion 250. That is, an outer cross-sectional dimension of each arm 230*a*, 230*b* is smaller than an inner cross-sectional dimension of corresponding arm 270*a*, 270*b*, thus enabling a telescoping relationship therebetween. Additionally, at least portions of proximal beam 252 and distal beam 260 of second portion 250 rest on top of portions of proximal beam 212 and distal beam 220 of first portion 210, respectively. Also, as shown in FIGS. 6A-6C, a proximal-most portion 213 of proximal beam 212 of first portion 210 is located proximally of a proximal-most portion 253 of proximal beam 252 of second portion 250. A distal-most portion 221 of distal beam 220 of first portion 210 is located distally of a distal-most portion 261 of distal beam 260 of second portion 250.

Third portion 300 is then placed on top of the approximated first and second portions 210, 250 such that pin 320*a*-320*d* are inserted through respective slots 254, 264, 274*a*, 274*b* of second portion 250 and at least partially through respective holes 214, 224, 234*a*, 234*b* of first portion 210. Therefore, as can be appreciated, first portion 210 and third portion 300 are substantially stationary with respect to each other. Additionally, second portion 250 is able to slide back-and-forth with respect to first portion 210 and third portion 300, thus adjusting the width "W" of adjustable shelf 200.

With continued regard to the adjustability of rack 100, adjustable connecting members 400, stabilizing members 120, and signage supports 520 are discussed herein. Adjustable connecting members 400 include a first portion 402 which telescopingly receives a second portion 404. While first and second portions 402, 404 are illustrated as cylinders, other shapes are usable. First portion 402 includes a plurality of holes 406, and in a disclosed embodiment second portion 404 includes an elongated slot and/or an upwardly-extending and upwardly-biased button. It is envisioned that button engages a hole 406 and/or that a pin is inserted through at least one hole 406 and at least partially through the slot to releasably lock first portion 402 and second portion 404 together.

Stabilizing members 120 are pinned to each other at or near their centers and each stabilizing member 120 engages both distal vertical frame supports 300*b*. More particularly, it is envisioned that each distal vertical frame support 300*b* includes a plurality of openings/grooves/holes, each of which being configured to releasably engage a portion (e.g., a pin) of each stabilizing member 120. That is, a portion of each stabilizing member 120 can engage a particular hole of vertical frame support 300*b* depending on the desired width of rack 100.

Figure 4:
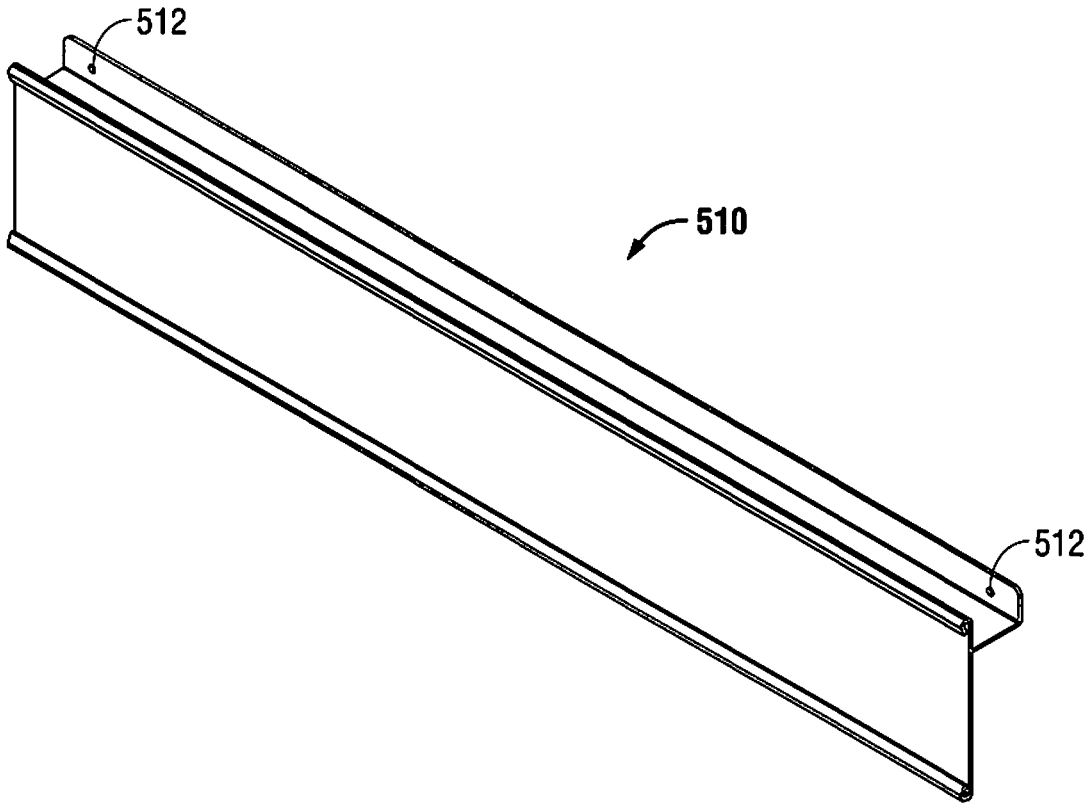
FIG. 4 is a perspective view of a signage display for use with the expandable rack and shelves of FIGS. 1-3.
Figure 5:
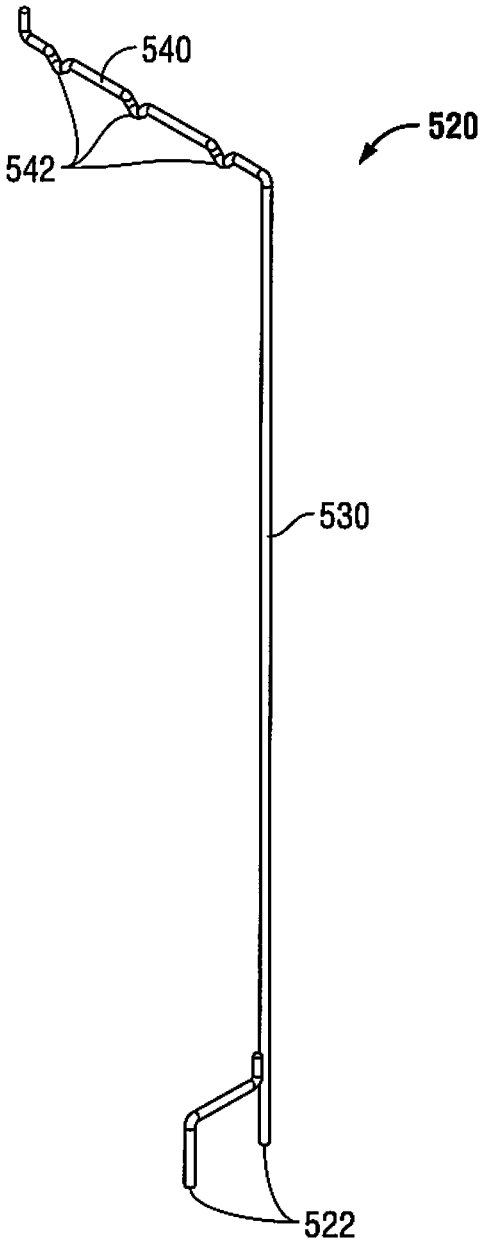
FIG. 5 is a perspective view of a signage support, which helps support the signage display of FIG. 4.

With reference to FIG. 5, signage supports 520 each include a base portion having a pair of prongs 522, which are configured to engage two of the three holes 452*a*-*c* on upper connecting member 450. More particularly, signage support 520*a* engages holes 452*b* and 452*c*, and signage support 520*b* engages holes 452*a* and 452*b*. In this regard, signage support 520*a* is able to be identical or substantially identical to signage support 520*b*. Signage supports 520 also include a vertical member 530 and an arm 540. Arm 540 includes a plurality of detents 542 (three detents are shown, but any number of detents can be included). Each hook 600 (FIG. 1) is supported by a detent 542, and each hook 600 supports a portion of signage display 510 via a hole 512 disposed therein (FIG. 4). The spacing of detents facilitates positioning of the hooks 600 when the rack 100 is expanded in each of the three widths W1, W2, and W3, for example.

Once assembled and installed, the shelves 200 of rack 100 can support products directly thereon, or the shelves 200 can support a product display apparatus (not shown), such as a gravity-feed product display, for example.

While several embodiments of the disclosure have been shown in the figures, it is not intended that the disclosure be limited thereto, as it is intended that the disclosure be as broad in scope as the art will allow and that the specification be read likewise. Therefore, the above description should not be construed as limiting, but merely as exemplifications of various embodiments. Those skilled in the art will envision other modifications within the scope and spirit of the claims appended hereto.

The invention claimed is:

1. An expandable rack, comprising:

a plurality of vertical frame members; and a plurality of adjustable shelves, each adjustable shelf of the plurality of adjustable shelves being at least partially supported by at least some of the vertical frame members of the plurality of vertical frame members, each adjustable shelf of the plurality of adjustable shelves comprising:

a first portion including a first lateral beam and at least two first arms extending perpendicularly therefrom, each of the first arms including a polygonal cross-section and including an opening extending at least partially therethrough;

a second portion including a second lateral beam and at least two second arms extending perpendicularly therefrom, each of the second arms including a polygonal cross-section and including a slot extending at least partially therethrough, each of the first arms is dimensioned to fit within one second arm in a telescoping relationship; and a third portion including an elongated strip, a first structure depending from the elongated strip, and a second structure depending from the elongated strip, the first structure is configured to engage the opening in one of the first arms and the slot in one of the second arms, and the second structure is configured to engage the opening in the other of the first arms and the slot in the other of the second arms.

2. The expandable rack of claim 1, wherein the second portion includes a third lateral beam such that each of the second arms extend between the second lateral beam and the third lateral beam.

3. The expandable rack of claim 1, wherein the first portion includes a proximal beam and a distal beam, each extending perpendicularly from the first lateral beam.

4. The expandable rack of claim 3, wherein the second portion includes a proximal beam and a distal beam, each extending perpendicularly from the second lateral beam.

5. The expandable rack of claim 1, wherein moving the second portion with respect to the first portion adjusts a width of the adjustable shelf of the plurality of adjustable shelves, the first portion and the third portion being stationary with respect to each other during adjustment of the width.

6. The expandable rack of claim 1, further comprising two upper connecting members which connect upper portions of adjacent vertical frame members of the plurality of vertical frame members, and a signage display system configured to extend vertically from the upper connecting members, the signage display system including two identical signage supports, each signage support mechanically engaging one of the upper connecting members.

* * * * *